US011142422B2

(12) United States Patent
Paanasalo

(10) Patent No.: US 11,142,422 B2
(45) Date of Patent: Oct. 12, 2021

(54) METHOD OF OPERATING AN OFF-LINE FINISHING DEVICE FOR FIBER WEBS, IN PARTICULAR AN OFF-LINE SLITTER-WINDER FOR WINDING FIBER WEBS

(71) Applicant: Valmet Technologies Oy, Espoo (FI)

(72) Inventor: Jari Paanasalo, Järvenpää (FI)

(73) Assignee: VALMET TECHNOLOGIES OY, Espoo (FI)

( * ) Notice: Subject to any disclaimer, the term of this patent is extended or adjusted under 35 U.S.C. 154(b) by 216 days.

(21) Appl. No.: 16/662,756

(22) Filed: Oct. 24, 2019

(65) Prior Publication Data

US 2020/0130976 A1 Apr. 30, 2020

(30) Foreign Application Priority Data

Oct. 24, 2018 (EP) ..... 18202188

(51) Int. Cl.
*B65H 26/02* (2006.01)
*B65H 18/08* (2006.01)

(52) U.S. Cl.
CPC ..... *B65H 26/025* (2013.01); *B65H 18/08* (2013.01); *B65H 2301/4148* (2013.01);
(Continued)

(58) Field of Classification Search
CPC ..... B65H 26/025; B65H 18/08; B65H 2301/4148; B65H 2557/24;
(Continued)

(56) References Cited

U.S. PATENT DOCUMENTS 4,438,889 A * 3/1984 Schonmeier ..... B65H 26/06 242/413.1
4,631,682 A * 12/1986 Ng ..... B65H 26/08 700/126

(Continued)

FOREIGN PATENT DOCUMENTS

EP 0839743 A2 5/1998
EP 1748011 A2 1/2007

(Continued)

OTHER PUBLICATIONS

Extended European Search Report for EP 18202188 dated Apr. 3, 2019.

*Primary Examiner* — Ziaul Karim
(74) *Attorney, Agent, or Firm* — Stiennon & Stiennon

(57) ABSTRACT

A method of operating an off-line finishing device for fiber webs, in particular an off-line slitter-winder for winding fiber webs, wherein in operating the off-line device the running speed is automatically optimized to minimize cost of web breaks. The method considers the costs associated with a web break during unwinding in addition to the cost benefit of maximizing web unwind speed so as to maximize machine utilization. The method determines an optimal web break stopping time in a web break situation and how often a web break is predicted. Automatic optimization incorporates limitations including the maximum rotation speed of the parent roll, the maximum speed of the fiber web being unwound, the maximum positive torque which can be applied to the parent roll to accelerate the parent roll to a rotation rate which produces a desired web speed, and maximum braking torque.

5 Claims, 3 Drawing Sheets

(52) U.S. Cl.
CPC .... *B65H 2557/24* (2013.01); *B65H 2601/525* (2013.01); *B65H 2601/60* (2013.01)

(58) Field of Classification Search
CPC ..... B65H 2601/525; B65H 2601/60; B65H 2511/142; B65H 2513/11; B65H 2513/20; B65H 2801/84; B65H 23/185
See application file for complete search history.

(56) References Cited

U.S. PATENT DOCUMENTS

| | | | | |
|---|---|---|---|---|
| 4,982,104 | A * | 1/1991 | Yuito | B65H 23/10 226/33 |
| 6,030,496 | A * | 2/2000 | Baggot | B65H 16/106 162/111 |
| 6,440,268 | B1 * | 8/2002 | Baggot | B65H 16/10 162/109 |
| 7,070,141 | B2 * | 7/2006 | Paanasalo | B65H 18/00 242/534.2 |
| 2004/0135024 | A1 * | 7/2004 | Paanasalo | B65H 26/08 242/534.2 |

FOREIGN PATENT DOCUMENTS

| | | | |
|---|---|---|---|
| EP | 2749513 | A1 | 7/2014 |
| FI | 125653 | B | 9/2008 |
| WO | 2010018305 | A1 | 2/2010 |

* cited by examiner

METHOD OF OPERATING AN OFF-LINE FINISHING DEVICE FOR FIBER WEBS, IN PARTICULAR AN OFF-LINE SLITTER-WINDER FOR WINDING FIBER WEBS

CROSS REFERENCES TO RELATED APPLICATIONS

This application claims priority on EP 18202188, filed Oct. 24, 2018, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method of operating an off-line finishing device for fiber webs, in particular an off-line slitter-winder for winding fiber webs into partial fiber web rolls. Especially the invention relates to a method of operating an off-line finishing device for fiber webs, in particular an off-line slitter-winder for winding fiber webs into partial fiber web rolls.

It is known that a fiber web, e.g. paper, is manufactured in machines which together constitute a paper-manufacturing line which can be hundreds of meters long. Modern paper machines can produce over 450,000 tons of paper per year. The speed of the paper machine can exceed 2,000 m/min and the width of the fiber web can be more than 11 meters.

In paper-manufacturing lines, the manufacture of paper takes place as a continuous process. A fiber web formed in the paper machine is reeled by a reel-up around a reeling shaft i.e. a reel spool into a parent roll the diameter of which can be more than 5 meters and the weight more than 160 tons. The purpose of reeling is to modify the fiber web manufactured as planar to a more easily processable form. On the reel-up located in the main machine line, the continuous process of the paper machine breaks for the first time and shifts into periodic operation.

In off-line finishing devices the parent roll is located in an unwinder and the fiber web is unwound from the parent roll guided through the off-line finishing device, for example a calender or a coater, for further treatment of the fiber web and then wound back to a parent roll by a reel-up.

One off-line finishing device is also a slitter-winder. The web of parent roll produced in the paper manufacture is full-width and even more than 100 km long, so it must be slit into partial webs with suitable width and length for the customers of the paper mill and wound around cores into so-called customer rolls before delivering them from the paper mill. This slitting and winding up of the web takes place as is known in an appropriate separate machine i.e. a slitter-winder.

On the slitter-winder, the parent roll is unwound, the wide web is slit on the slitting section into several narrower partial webs which are wound up on the winding section around winding cores, such as spools, into customer rolls. When the customer rolls are completed, the slitter-winder is stopped and the wound rolls i.e. the so-called set is removed from the machine. Then, the process is continued with the winding of a new set from the parent roll. From one parent roll several sets of customer rolls are wound. These periods of so-called set change are repeated in sequences periodically until paper runs out of the parent roll, whereby a parent roll change is performed, and the operation starts again as the unwinding of a new parent roll.

Slitter-winders employ winding devices of different types depending on, inter alia, the type of the fiber web being wound. On slitter-winders of the two drum winder type, the web is guided from the unwinding via guide rolls to the slitting section where the web is slit into partial webs which are further guided to the winding (support or carrier) drum of the two drum winder and slit component webs are wound around a winding core on support of the winding drums. On slitter-winders of the multistation winder type, the web is guided from the unwinding via guide rolls to the slitting section where the web is slit into partial webs which are further guided to the winding drum/drums on the winding stations into customer rolls to be wound up onto cores. Adjacent partial webs are wound up on different sides of the winding drum/drums. Multistation winders have one to three winding drums and in them each partial web is wound to a partial web roll in its own winding station.

The slitter-winder has as parts of its operating process the step of set-change and the step of slitting and winding process which occur one after the other. The slitting and winding process may also be considered to have an acceleration period after the set change, a normal slitting and winding period and a deceleration period preceding the set change. Of these process steps the normal slitting and winding period takes the longest time and the web speed can be typically as high as 3000 in/min (50 m/s). Thus, in winding applications for slitter-winders the parent roll should in the beginning of winding be accelerated to the speed needed and at the end decelerated to a very slow speed and then stopped.

During past years the efficiency of slitter-winders has been improved considerably for example by increasing running speeds. The total efficiency is naturally influenced by efficiency of operation in all periods, but typically the normal slitting and winding process is the one which is most easily adjusted to improve efficiency.

It is known to limit the acceleration rate when the diameter of the parent roll in unwinding is at its largest due to: the torque transfer capacity of the existing reeling shaft, or the limitations of the mechanical drive, or for optimizing the size of the electric drive. In these techniques the simple limit value approach has been employed and when the diameter of the parent roll has decreased below the predetermined fixed limit value, a higher acceleration rate has been introduced.

In FI patent publication 125653 is disclosed an electric drive arrangement for a section or device of a fiber web machine having an electric drive and an electric drive control arrangement, where the electric drive is controlled based on the thermal capacity of the electric drive and/or its control arrangement.

In EP patent publication 0839743 is disclosed a method in winding of a paper web, in which the running speed of the winder is controlled based on the frequency of rotation of the paper roll that is being wound such that the intensive vibration causing ranges of frequency of rotation are avoided by lowering the running speed of the winder.

In WO publication 2010/018305 is disclosed a method in which problems incurred by vibration during acceleration period are avoided or minimized as the slitting starts the speed is accelerated to the normal slitting speed using more than one acceleration rate.

In US patent publication 7070141 is disclosed a method for controlling a winder, in which the stopping of the winder is controlled such that winding is stopped when a desired length of a web has been wound on a roll being formed/unwound from a roll being formed or when the size of the diameter of the roll is desired and an estimated stopping length is calculated based on speed, acceleration and a desired end speed.

In EP publication 2749513 is disclosed a method of operating a slitter-winder for winding fiber webs into partial fiber web rolls, in which the time period of slitting and winding of one set of partial web rolls comprises acceleration period, normal running speed period and deceleration period, in which during the acceleration period the speed of the slitter-winder is accelerated to normal running speed of slitting and winding, and in operating the slitter-winder the speed is accelerated to the normal running speed of slitting and winding in the beginning of winding the set of the partial fiber web rolls by using high acceleration rate from 1.3 $m/s^2$ to 3.0 $m/s^2$. By the high acceleration rate the partial fiber web rolls are wound to good roundness and thus vibrations do not occur during the acceleration period or during winding. The high acceleration rate also results as increased capacity since the time needed for one period of slitting and winding one set of partial fiber web rolls is considerably shortened.

During unwinding in the unwinder of the off-line finishing device for fiber webs sometimes a web break may occur. Sometimes the web break may occur just as the substantially full parent roll has been accelerated to high running speed, in this situation the time to stop the high running speed of the rotating parent roll will be at its longest. Thus a vast amount of web will be unwound and thus wasted, causing bits and pieces and scraps of the fiber web until the parent roll is stopped. Thereafter cleanup takes a long time, which may also increase the unproductive time of the unwinding process. Due to the possibility of the web break in the beginning of unwinding the full or substantially full parent roll, operating personnel in practice often do not use the maximum running speed during the beginning of the unwinding, which causes losses in capacity.

The time for stopping the rotating of the parent roll in the web break situation can be decreased by increasing the power of brake generators or mechanical brakes, but this increases the cost of the device.

Many of the above problems and disadvantages occur in unwinding irrespective of the type of the off-line finishing devices and especially they occur and cause problems and disadvantages in slitter-winders during the winding of the first one or two sets of customer rolls from the substantially full parent roll regardless of the type of the slitter-winder used.

SUMMARY OF THE INVENTION

One object of the invention is to eliminate or at least minimize the above problems and disadvantages of off-line devices, especially of slitter-winders, for fiber webs known from the prior art, in particular caused by web breaks.

Another object of the invention is to create a method of operating a slitter-winder in which the problems and disadvantages caused by web breaks are eliminated or at least minimized.

Another particular object of the invention is to provide a method of operating a slitter-winder in which the problems caused by web breaks during unwinding for the first few sets of customer rolls from the parent roll when the parent roll is at its largest.

Another object of the invention is to create a method of operating a slitter-winder by which capacity of the slitter-winder is increased.

To achieve the above objects and those which will come out later, the method of operating the off-line finishing device for fiber webs, in particular the off-line slitter-winder for winding fiber webs according to the invention is such that in operating the off-line device the running speed is automatically optimized not to exceed a selected stopping time when the web breaks.

According to the invention in the method of operating an off-line finishing device for fiber webs, in particular an off-line slitter-winder for winding fiber webs into partial fiber web rolls, in operating the off-line device the running speed is automatically optimized such that a selected or optimal web break stopping time at a web break situation is not exceeded.

According to an advantageous feature of the invention in operating the off-line device the running speed is optimized such that the optimal web break stopping time is achieved with respect to unwinding, in an unwinder of a finishing device for fiber webs.

According to an advantageous feature of the invention the optimal web break stopping time is determined based on calculations based on a model or on known data or on measured data.

According to an advantageous feature of the invention in the method of operating the off-line finishing device for fiber webs, in particular the off-line slitter-winder for winding fiber webs, the optimal web break stopping time is determined based on a self-learning algorithm. According to an advantageous feature of the invention the method comprises the following steps:

- based on a model it is pre-calculated how much a web break stopping time limitation decreases capacity of the finishing device for fiber webs,
- collecting continuously data relating to frequency of occurrence of web breaks,
- probability of occurrence of a web break is determined based on the collected data relating to frequency of occurrence of web breaks,
- expected value of capacity loss is calculated based on the determined probability of occurrence of a web break which in turn is based on collected data relating to frequency of occurrence of web breaks,
- optimal web break stopping time is adjusted such that the expectation value of capacity loss is minimized,
- the expected value of capacity loss is continuously adjusted as the probability of occurrence of a web break is updated, while running at lower (than maximum running speed) speeds,
  - in the method the optimal web break stopping time decreases or increases depending on the actual frequency of the web breaks and thus in case of no web breaks the optimal web break stopping time increases to a level not limiting the running speed.

According to an advantageous feature of the invention in the method of operating the off-line finishing device for fiber webs, in particular the off-line slitter-winder for winding fiber webs, the running speed of the off-line finishing device is controlled, advantageously automatically limited such that the optimal web break stopping time at a web break situation is not exceeded.

According to an advantageous feature of the invention in the method of operating the off-line finishing device for fiber webs, in particular the off-line slitter-winder for winding fiber webs, the running speed of the off-line finishing device is increased as inertia of a parent roll in the unwinder decreases.

According to an advantageous feature of the invention method of operating an off-line slitter-winder the web break stopping time is automatically controlled based on maximizing the capacity of the off-line slitter-winder.

According to an advantageous feature of the invention in the method, is based on the maximum torque of the brake generator and/or on the maximum torque of the mechanical brake and continuously calculating the continuously decreasing inertia caused by the unwinding of the parent roll. Inertia and maximum breaking torque determine the maximum running speed, which will not exceed the optimal web break stopping time.

According to an advantageous feature of the invention in the method the web break deceleration time i.e. the web break stopping time of an unwinder is limited based on the method steps: a) inertia of a parent roll is calculated in the inertia calculation stage, b) in the maximum web break deceleration calculation stage the maximum web break deceleration is calculated, c) in the maximum speed set value calculation stage the maximum speed set value is calculated, d) the set value of the speed is compared to the maximum set value of the speed, e) depending on the result of the comparison the running speed value is set to the set value of the speed or to the maximum set value of the speed, f) the unwinder is run with the running speed value, g) and the method is begun again from the inertia calculation stage.

The present invention relates to off-line unwinding in an unwinder for fiber webs and is utilizable irrespective of the type of the off-line finishing device and especially advantageously the invention is utilizable in slitter-winders and in particular during the winding of the first one or two sets of customer rolls from the substantially full parent roll regardless of the type of the slitter-winder even though as an off-line finishing device an off-line slitter-winder for winding fiber webs has been in some cases described in reference to one possible example.

According to an advantageous aspect of the invention in the method of operating the off-line finishing device for fiber webs, in particular the off-line slitter-winder for winding fiber webs, the running speed of the off-line finishing device is controlled, for example automatically limited, such that an optimal web break stopping time at a web break situation is not exceeded. Based on the maximum torque of the break generator and/or the maximum torque of the mechanical break and on the decreasing inertia (caused by the decreasing of the parent roll diameter during unwinding) the transitory running speed, which is not to be exceeded in order not to exceed the optimal web break stopping time is continuously calculated. For example in a slitter winder the running speed during unwinding for the first and the second set of customer rolls from a substantially full parent roll may be lower than during the unwinding for the other sets of the customer rolls, but still the highest possible for the optimal web break stopping time.

By the method according to the invention capacity losses are optimized and in the case of a web break situation the amount of web waste unwound, and bits and pieces and scraps of the fiber web caused, is low and significantly decreased. Additionally, by the invention the probability of a web break decreases.

In this description and the claims by fiber web is meant paper web, board web and pulp web.

BRIEF DESCRIPTION OF THE DRAWINGS

In the following the invention is further described referring to the accompanying schematic figures in which In FIG. 1 is shown a flow diagram of the method steps of the invention for limiting the deceleration time for a parent roll when the web breaks.

DESCRIPTION OF THE PREFERRED EMBODIMENTS

Figure 2:
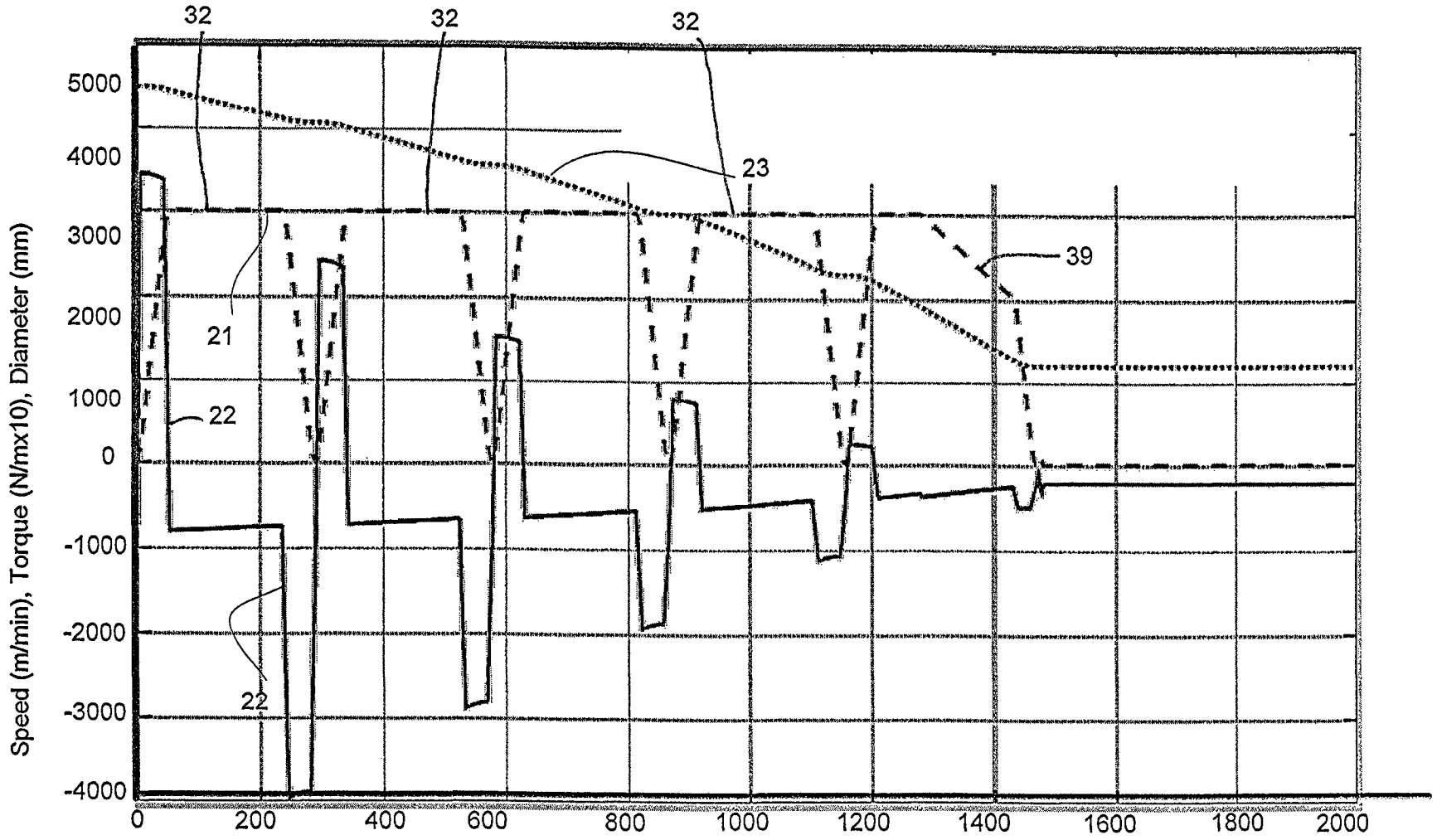
In FIG. 2 is shown graphs of speed, torque, and parent roll diameter vs time for a simulated run of a slitter-winder where the maximum running speed of the web Vmax is not reduced until the last set where running speed is reduced below Vmax required by a limit on the maximum rotation rate of the parent roll.
Figure 3:
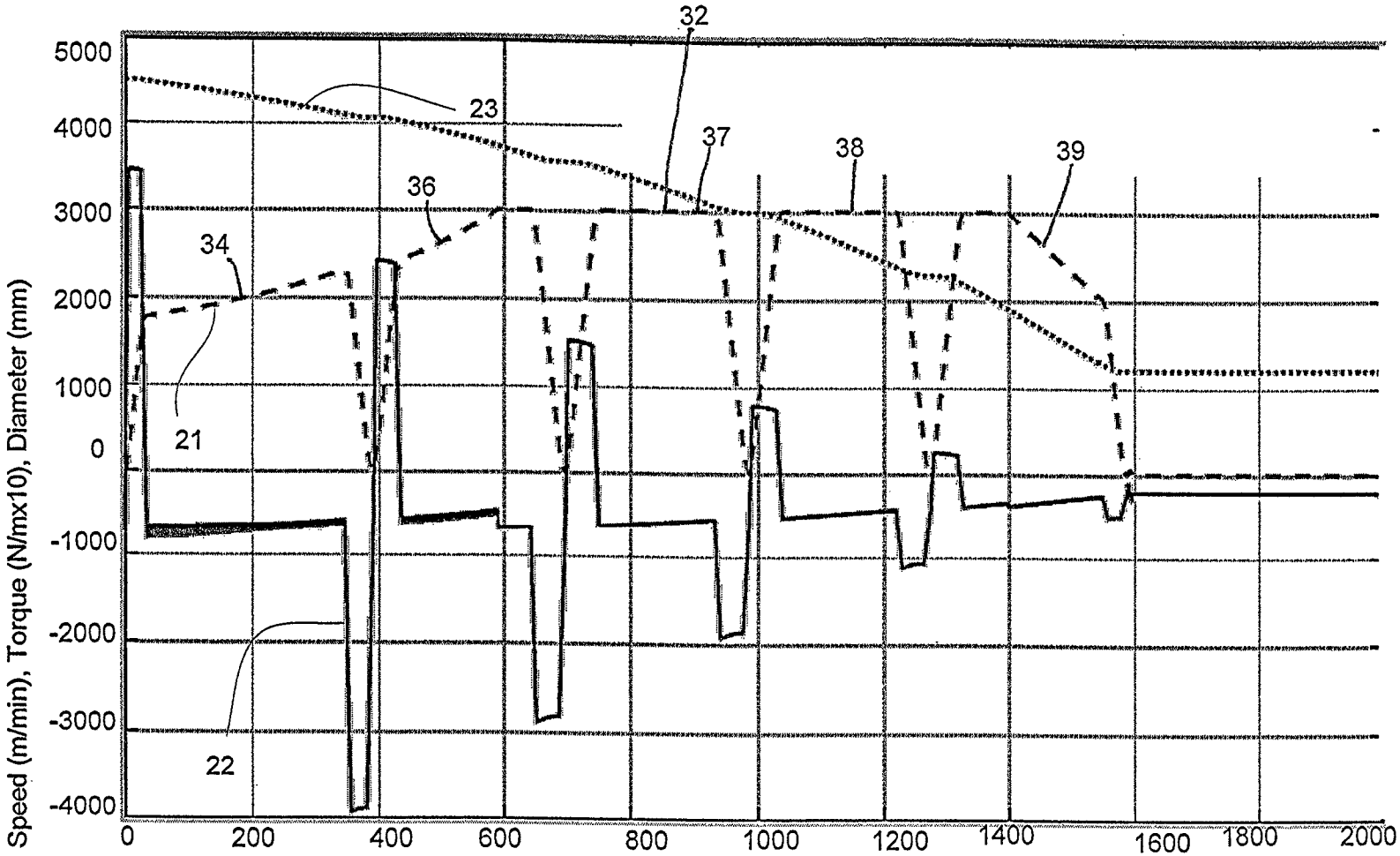
In FIG. 3 is shown graphs of speed, torque, and parent roll diameter vs time for a simulated run of a slitter-winder where Vset is less than Vmax during the first set and part of the second sets, such that running speed during the first set and part of the second, set is continuously increasing as the parent roll inertia is decreasing until Vset=Vmax.

The method of this invention is used to optimize productivity of a web handling machine for processing of the web which involves unwinding a parent roll. One particular application involves an off-line slitter-winder for winding fiber webs into partial fiber web from a parent, or machine roll to form a customer roll sets 34, 35, 37, 38, and 39 as shown in FIG. 3. The process takes into account various limitations of the web handling machine, in particular limitations associated with unwinding the parent roll. These limitations include: the maximum allowed rotation speed of the parent roll as shown in FIGS. 2 and 3 which limits web speed when the parent roll diameter is about 1.9 meters and is rotating at 500 rpm, the maximum speed of the fiber web Vmax (3000 m/minutes) being unwound, the maximum negative torque is ((D(m))/2(Tm (Nm)+Tb(Nm))Z) which can be applied to the parent roll to bring the parent roll to a stop when the web breaks. The invention is particularly concerned with taking into account the costs associated with a web break during unwinding. A break has cost associated therewith, including the amount of fiber web which must be recycled and the time lost due to cleaning up the web break and restarting the unwinding process. These costs are related to how long it takes to stop the rotation of the parent roll when a break is detected, because the longer stopping time results in more fiber web which must be recycled, and more time required for cleanup and restarting of the unwinding process. The total cost of web breaks depends on how often they happen and how much time is required to restart the unwinding process after a break happens. It is desirable to minimize or eliminate breaks thereby minimizing or completing eliminating the cost associated with a web break. However, practically web breaks cannot be completely eliminated, and their frequency may change over time due to many reasons associated with the fiber web, the operation of the unwinder, etc. The nature of web breaks are such that their occurrence is random or at least cannot be predicted in the short run, however the frequency of web breaks, although changing, can be predicted based on recent history.

Reducing the maximum stopping time reduces the amount of paper which must be recycled and the time to recover, and thus reduces the costs associated with a web break. However, reducing stopping time itself has costs if it reduces the speed of the fiber web as it is unwound. These costs tend to be constant while the costs associated with a fiber web break vary with the frequency of the web breaks. Given a known correlation between stopping time and cost of a web break, and historical data concerning past web breaks, a stopping time which minimizes overall cost can be selected.

Figure 1:
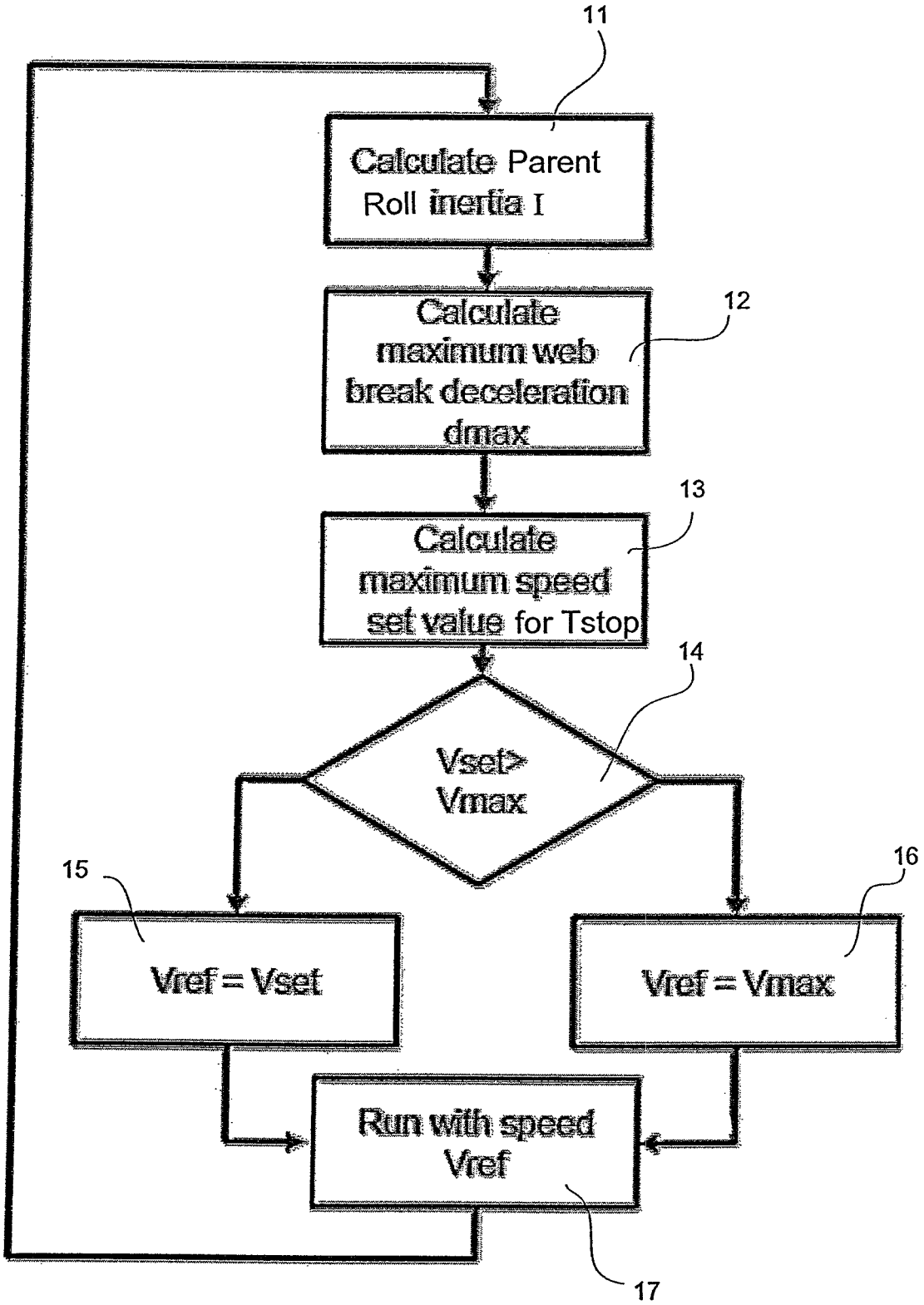

In FIG. 1 is shown a flow chart for limiting the web break deceleration time, i.e. the web break stopping time of an unwinder according to an advantageous example of the invention. In the method first, inertia (I) of a parent roll is calculated in the inertia calculation stage 11, which is followed by a maximum web break deceleration calculation stage 12, in which the maximum web break deceleration (dmax) is calculated. In the maximum speed set value calculation stage 13 the maximum speed set value is (Vmax). In the next step 14 the set value of the speed (Vset) is compared to the maximum set value of the speed (Vmax). Depending on the result of the comparison the running speed value (Vref) is set to the set value of the speed (Vset) in stage 15 or to the maximum set value of the speed (Vmax) in stage 16, and the unwinder is run with the running speed (Vref), as shown in stage 17. After stage 17 the method is begun again from the inertia calculation stage 11.

The inertia of the parent roll is calculated based on the equation:

$$1.\ I(\mathrm{kgm}^2) = \frac{\pi\rho W}{32}(D^4 - D0^4).$$

The maximum web break deceleration is calculated based on the equation:

$$2.\ \text{Liner deacceleration } d\max\left(\frac{\mathrm{m}}{\mathrm{s}^2}\right) = \frac{\frac{D(\mathrm{m})}{2}(Tm(Nm) + Tb(Nm))Z}{I}$$

The maximum speed set value (Vset) is calculated based on the equation:

$$V\mathrm{set}(\mathrm{m/s}) = d\max * T\mathrm{stop}(\mathrm{s}) \quad 3.$$

In the above equations the symbols used (and their units) are:

I=parent roll inertia ($\mathrm{kgm}^2$)
p=web density ($\mathrm{kg/m}^3$)
W=web width (m)
D=parent roll diameter (m)
DO=reeling shaft diameter (m)
Tm=maximum motor torque (Nm)
Tb=mechanical brake torque (Nm)
Z=gear ratio
Tstop=user given web break deceleration time (s)
Vmax=machine limit speed web velocity e.g. 3000 m/minutes or 50 m/s
DZ(Tm+Tb)/2=Total Brake Torque=e.g., −40,000N·m (set by machine design)

In FIGS. 2-3 are shown plotted curves of example simulated runs of a slitter-winder in cases of simulating a run of 5 sets of customer rolls from a 4.5 m diameter parent roll. On the horizontal axis is shown the time (s) and on the vertical axis are shown the running speed (m/min), the torque (N·m×10) and the diameter (mm) of the parent roll. Curve 21 in FIG. 3 shows the speed as limited by the parent roll inertia and the web break stop time (Tstop), curve 22 shows the unwind torque divided/10, and curve 23 shows the roll diameter.

In the example of FIG. 2 the parent roll total running time is 1482 seconds, and the web break stopping time is set to a maximum of 30 seconds. No speed limitation occurs due to parent roll inertia (I) because the maximum 32 speed set value (Vmax) does not need to be further limited to control angular momentum of the roll because the 30 seconds web break stopping time can be achieved with the available braking torque when using the maximum running speed (Vmax). The speed of the last set 39 of the customer rolls is limited by an unwind maximum rotational speed. In this simulation the web braking time (Tstop) of the unwinder was limited to 30 seconds which allows operation at Vmax.

In the example of FIG. 3 the parent roll running time is 1597 seconds, and the web break stopping time (Tstop) is set to a maximum of 15 seconds. During running of the first set 34 and the second set 36 of the customer rolls the web break stopping time of 15 seconds cannot be archived at Vmax with the available braking torque. Thus until the inertia I of the roll is decreased by unwinding some of the web on the parent roll, the speed of the web 21 must be controlled to a limited web break stopping time to a maximum 15 seconds. In this simulation the web break time i.e., the web break stopping time was limited to 15 seconds by limiting the running speed reference value. When compared to the example of FIG. 2, in which the running speed is not limited it can be seen in the example of FIG. 3 how much the speed is limited in order not to exceed the 15 seconds web break stopping time and how much it increases the running time.

I claim:

1. A method of operating an off-line slitter winder finishing device for fiber webs, having an unwinder and a parent roll mounted thereto, the parent roll having a fiber web with a fiber web length, the unwinder having a maximum web speed, and at least one torque drive motor for controlling an unwind velocity of the parent roll, and at least one torque brake, wherein said at least one torque brake comprises at least one of said torque drive motor and a mechanical brake, the at least one torque brake having a selected braking torque, the method comprising the steps of:

using a model of the off-line slitter winder finishing device for fiber webs to pre-calculate a limit of a web break stopping time required by the selected braking torque in relation to the parent roll inertia and web unwind speed and how much setting a maximum web break stopping time decreases capacity of the finishing device for fiber webs by decreasing average web unwind speed;

collecting continuously data relating to frequency of occurrence of web breaks per parent roll to determine probability of occurrence of a web break;

calculating expected value of capacity loss based on the determined probability of occurrence of a web break and the web break stopping time; and while the web unwind speed is lower than maximum running speed, adjusting the maximum web break stopping time and thus the web unwind speed such that the expected value of capacity loss is minimized, wherein the expected value of capacity loss is continuously adjusted as the probability of occurrence of a web break is updated.

2. A method of operating an off-line finishing device for fiber webs, the device having an unwinder and a parent roll mounted thereto, the unwinder having a torque drive and a torque break, the method comprising:

selecting a maximum web speed for unwinding the fiber web;

determining a web break frequency based on a history for a selected number of parent rolls which have been unwound most recently, by dividing the number of web breaks by the number of the selected number of parent rolls which have been unwound;

defining a web break cost as a function of parent roll rotation speed;

defining a cost of incremental increased time to unwind the parent roll caused by reducing web speed below the maximum web speed; and adjusting parent roll rotation speed so as to minimizing a total cost due to web breaks and cost of increased time to unwind the parent roll due to unwinding at less than the selected maximum web speed.

3. The method of claim 2 wherein the web break cost is a function of one half of the parent roll rotation speed at break, times the selected time to stop rotation of the parent roll plus a fixed cost corresponding to a web break at zero web speed.

4. The method of claim 3 wherein the cost of incremental increased time to unwind the parent roll is a function of an allocation of total cost of operating the off-line finishing device for fiber webs on a time basis.

5. The method of claim 3 wherein the time to stop rotation of the parent roll is determined based on a self-learning algorithm using multiple data instances selected from at least one of: an occurrence of web breaks, total time to unwind the parent rolls in the off-line finishing device for fiber webs, cost of web breaks, total cost of processing the parent rolls in the off-line finishing device, and time to stop of the parent roll following a web break.

* * * * *